US009004641B2

(12) United States Patent
Tajima

(10) Patent No.: US 9,004,641 B2
(45) Date of Patent: Apr. 14, 2015

(54) LIQUID DROPLET DISCHARGE HEAD, LIQUID DROPLET DISCHARGE APPARATUS, AND IMAGE FORMING APPARATUS

(71) Applicant: Yukitoshi Tajima, Kanagawa (JP)

(72) Inventor: Yukitoshi Tajima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 11 days.

(21) Appl. No.: 13/737,404

(22) Filed: Jan. 9, 2013

(65) Prior Publication Data

US 2013/0176365 A1 Jul. 11, 2013

(30) Foreign Application Priority Data

Jan. 10, 2012 (JP) ..... 2012-002533

(51) Int. Cl.
*B41J 2/045* (2006.01)
*B41J 2/015* (2006.01)
*B41J 2/14* (2006.01)

(52) U.S. Cl.
CPC ..... *B41J 2/045* (2013.01); *B41J 2/14233* (2013.01); *B41J 2002/14419* (2013.01)

(58) Field of Classification Search
None
See application file for complete search history.

(56) References Cited

U.S. PATENT DOCUMENTS

| | | | | |
|---|---|---|---|---|
| 6,955,418 | B2 | 10/2005 | Ito | |
| 7,429,099 | B2 | 9/2008 | Sugimoto et al. | |
| 2005/0116992 | A1* | 6/2005 | Akahane | 347/54 |
| 2008/0078740 | A1* | 4/2008 | Kitahara | 216/27 |
| 2009/0017263 | A1* | 1/2009 | Yeates | 428/167 |
| 2010/0302323 | A1 | 12/2010 | Yagi et al. | |
| 2010/0315471 | A1 | 12/2010 | Kihira et al. | |
| 2011/0122199 | A1 | 5/2011 | Takemoto et al. | |
| 2011/0318585 | A1* | 12/2011 | Su et al. | 428/419 |
| 2012/0236067 | A1 | 9/2012 | Tajima et al. | |

FOREIGN PATENT DOCUMENTS

| | | |
|---|---|---|
| JP | 07-178906 | 7/1995 |
| JP | 09-295403 | 11/1997 |
| JP | 2000-289206 | 10/2000 |
| JP | 2004-025636 | 1/2004 |
| JP | 2006-095884 | 4/2006 |
| WO | WO2009/011398 A1 | 1/2009 |

OTHER PUBLICATIONS

U.S. Appl. No. 13/544,318, filed Jul. 20, 2012, Nishimura et al.
U.S. Appl. No. 13/609,897, filed Sep. 11, 2012, Nishimura et al.

* cited by examiner

*Primary Examiner* — Matthew Luu
*Assistant Examiner* — Erica Lin
(74) *Attorney, Agent, or Firm* — Oblon, McClelland, Maier & Neustadt, L.L.P.

(57) ABSTRACT

A liquid droplet discharge head includes a nozzle substrate having a nozzle hole; a liquid chamber substrate including a liquid chamber that is in communication with the nozzle hole and a liquid introduction path; an oscillation plate forming a part of the liquid chamber; an electromechanical conversion element that is arranged on the oscillation plate and is configured to be deformed by a voltage applied from the exterior to cause the oscillation plate to deform and the liquid chamber to generate pressure so that liquid within the liquid chamber is discharged from the nozzle hole; a common liquid chamber that is in communication with the liquid chamber via the liquid introduction path and is configured to supply liquid to the liquid chamber; and a common liquid chamber forming substrate that includes a single metal plate integrated with resin to form the common liquid chamber.

20 Claims, 9 Drawing Sheets

LIQUID DROPLET DISCHARGE HEAD, LIQUID DROPLET DISCHARGE APPARATUS, AND IMAGE FORMING APPARATUS

BACKGROUND OF THE INVENTION

1. Field of the Invention

The disclosures herein generally relate to a liquid droplet discharge head, a liquid droplet discharge apparatus including the liquid droplet discharge head, and an image forming apparatus including the liquid droplet discharge apparatus; and particularly to a liquid droplet discharge head used in an image forming apparatus such as a printer, a facsimile machine, a copier, a plotter, or a multifunction peripheral (MFP) having more than one of the above functions.

2. Description of the Related Art

An image forming apparatus such as a printer, a facsimile machine, a copier, a plotter, or a MFP having more than one of the above functions may use a liquid droplet discharge apparatus (also referred to as "liquid discharge apparatus") including a liquid droplet discharge head (also referred to as "liquid discharge head" or "recording head" hereinafter) that discharges droplets of recording liquid such as ink to form an image by discharging the recording liquid on a recording medium such as paper that is being transported.

To simplify the structure of such a liquid droplet discharge head and reduce its manufacturing cost, techniques related to creating a common liquid chamber for storing recording liquid such as ink by arranging multiple layers of pressed parts are being adopted especially in an inkjet head that discharges ink. (See, e.g., Patent Documents 1 and 2)

Patent Documents 1 and 2 disclose a technique for creating a common liquid chamber by layering plural metal plates and resin plates and bonding the plates together by applying adhesive to the plates and heating/pressing the plates.

Patent Document 3 discloses a technique for creating a common liquid chamber by laminating plural photosensitive resin plates.

[Patent Document 1] Japanese Laid-Open Patent Publication No. 2004-025636

[Patent Document 2] Japanese Laid-Open Patent Publication No. 2006-095884

[Patent Document 3] Japanese Laid-Open Patent Publication No. 09-295403

However, the techniques disclosed in Patent Documents 1-3 require a relatively large number of parts for creating the common liquid chamber so that a relatively large number of assembly steps are required, which leads to an increase in manufacturing costs.

That is, in the case of creating parts from a metal plate by punch pressing the metal plate, restrictions are imposed on the thickness of the metal plate in consideration of the aspect ratio so that the number of layers has to be increased in order to secure the required volume for the common liquid chamber. When the number of layers is increased, the process steps for assembling the recording head are increased in number and complexity due to the increased number of bonding faces and the need to determine the positions of each of the layers, which in turn leads to an increase in manufacturing costs.

It is noted that the aspect ratio refers to the ratio of the plate thickness to the shortest distance between adjacent punch pressed parts. If the shortest distance between adjacent punch pressed parts is less than the plate thickness, accuracy of the punch pressed product cannot be ensured. For example, when a metal plate made of steel or stainless steel (SUS) with a plate thickness of 0.5 mm is used to create two holes corresponding to adjacent punch pressed parts, the holes may not be accurately punch pressed if the distance between the holes (i.e., dimension of the portion that is not perforated) is less than 0.5 mm.

SUMMARY OF THE INVENTION

It is a general object of at least one embodiment of the present invention to provide a liquid droplet discharge head that substantially obviates one or more problems caused by the limitations and disadvantages of the related art. One particular object of at least one embodiment of the present invention is to provide a moderately priced liquid droplet discharge head by reducing the number of parts and reducing the number of assembly steps for creating a common liquid chamber of the liquid droplet discharge head.

In one embodiment, a liquid droplet discharge head includes a nozzle substrate that has a nozzle hole for discharging a liquid droplet; a liquid chamber substrate that includes a liquid chamber that is in communication with the nozzle hole and a liquid introduction path for introducing liquid into the liquid chamber; an oscillation plate that forms a part of the liquid chamber; an electromechanical conversion element that is arranged on the oscillation plate at a location corresponding to the liquid chamber, the electromechanical conversion element being deformed by a voltage applied from an exterior to cause the oscillation plate to deform and the liquid chamber to generate pressure so that the liquid within the liquid chamber is discharged from the nozzle hole; a common liquid chamber that is in communication with the liquid chamber via the liquid introduction path and is configured to supply the liquid to the liquid chamber; and a common liquid chamber forming substrate that includes a single metal plate integrated with resin to form the common liquid chamber.

According to an aspect of the present invention, the number of parts and the number of assembly steps for creating a common liquid chamber of the liquid droplet discharge head may be reduced so that the liquid droplet discharge head may be moderately priced, for example.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
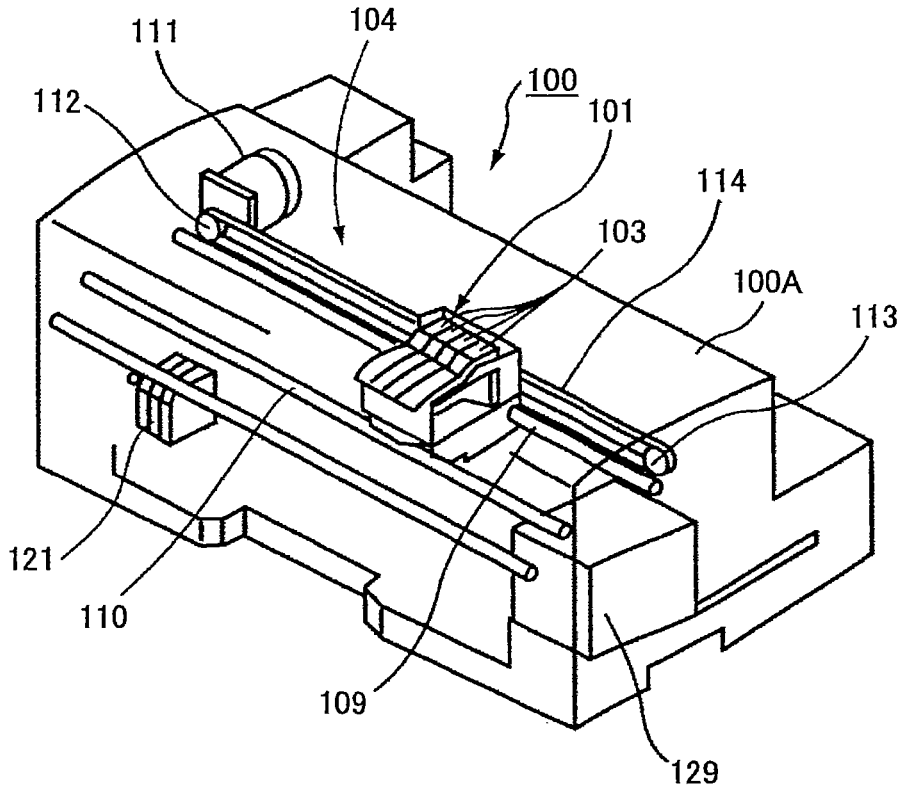
FIG. 1 is a perspective view of an inkjet recording apparatus according to a first embodiment of the present invention.

In the following, embodiments of the present invention are described with reference to the accompanying drawings. It is noted that in the embodiments described below, elements and features that may be substantially identical are given the same reference numerals and their descriptions may be omitted once they are described in connection with another embodiment.

It is noted that in the following descriptions, a liquid discharge type "image forming apparatus" refers to any type of apparatus that forms an image by having liquid droplets discharged on a medium such as paper, thread, fiber, cloth, leather, metal, plastic, glass, wood, or ceramics, for example. Also, "image forming" simply refers to discharging liquid droplets on a medium and may encompass rendering an image having a meaning such as a character or a figure on the medium as well as rendering an image having no meaning such as a pattern on the medium, for example.

Also, "liquid droplet" is not limited to ink and encompasses any type of liquid that may be arranged into fine droplets to form an image including recording liquids, fixing solutions, and resins, for example. Also, "recording medium" is not limited to paper and includes all types of media on which liquid droplets may be discharged such as OHP sheets and cloth. The term is used to generically refer to all forms of media including recording paper, recording sheets, cardboard paper, thin paper, postcards, and envelopes, for example. Also, "image" is not limited a two-dimensional image and also encompasses a three-dimensional image.

First Embodiment

Figure 2:
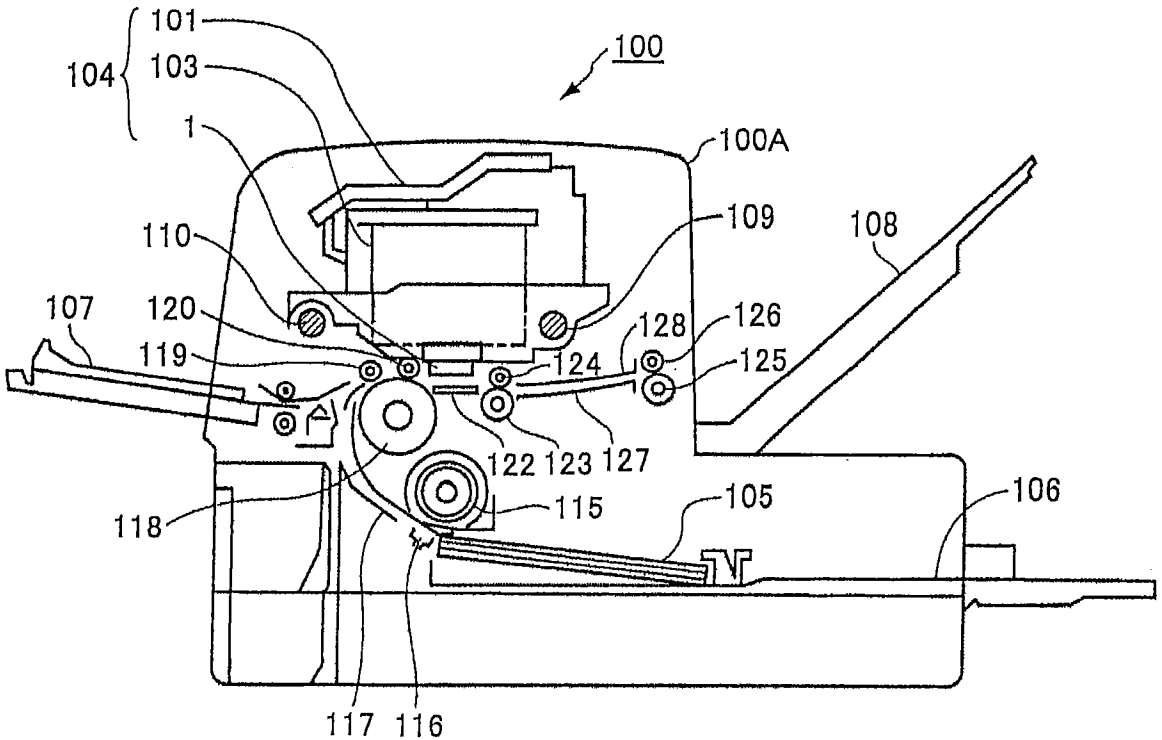
FIG. 2 is a cross-sectional view of the inkjet recording apparatus according to the first embodiment.

In the following, an overall configuration of an inkjet recording apparatus 100 as an exemplary embodiment of an image forming apparatus according to the present invention is described with reference to FIGS. 1 and 2. FIG. 1 is a perspective view of the inkjet recording apparatus 100 according to a first embodiment of the present invention. FIG. 2 is a partial cross-sectional view of a mechanical part of the inkjet recording apparatus 100.

The inkjet recording apparatus 100 includes an inkjet recording head (also referred to as "recording head" hereinafter) 1 corresponding to an exemplary embodiment of a liquid droplet discharge head of the present invention. The recording head 1 is described in detail below as a second embodiment of the present invention with reference to FIG. 4.

The inkjet recording apparatus 100 is a so-called serial type inkjet recording apparatus that includes a recording apparatus main frame 100A that accommodates a printing mechanism part 104 including a carriage 101 that is movable in a main scanning direction, the recording head 1 that is arranged at a bottom portion of the carriage 101, and an ink cartridge 103 that supplies ink to the recording head 1.

As is shown in FIG. 2, a paper feed cassette 106 that accommodates plural sheets of paper 105 stacked thereon from the front side (left side in FIG. 2) is arranged at the bottom portion of the recording apparatus main frame 101A in a manner such that the paper feed cassette 106 may be freely drawn out and inserted back into the recording apparatus main frame 101A. A manual feed tray 107 for manually feeding paper is arranged at the recording apparatus main frame 101A above the paper feed cassette 106 in a manner such that the manual feed tray 107 may swing back and forth to open and close with respect to the recording apparatus main frame 100A. The paper 105 that is fed from the paper feed cassette 106 or the manual feed tray 107 is transported to the printing mechanism part 104 so that a predetermined image may be recorded on the paper 105. Then, the paper 105 is delivered to a delivery tray 108 arranged at the rear side (right side of FIG. 2).

The carriage 101 of the printing mechanism part 104 is held by a main guide rod 109 and a sub guide rod 110 that extend across left and right side walls (not shown) so that carriage 101 may slide in the main scanning direction. The recording head 1 is configured to discharge ink droplets in the colors yellow (Y), cyan (C), magenta (M), and black (Bk) and includes plural ink discharge outlets (nozzles) aligned in a direction perpendicular to the main scanning direction. The recording head 1 is installed in the carriage 101 in a manner such that the ink discharge direction is downward.

The ink cartridges 103 that supply ink in the above colors to the recording head 1 are detachably installed in the carriage 101 so that they may be exchanged. The ink cartridge 103 has an atmospheric port that is in communication with the atmosphere at the upper side, a supply port for supplying ink to the recording head 1 at the lower side, and a porous body that is filled with ink arranged inside. The capillary force of the porous body maintains the ink to be supplied to the recording head 1 at a slightly negative pressure. It is noted that in the present example, the recording head 1 has plural heads corresponding to the different colors. However, in other examples, the recording head 1 may have one single head with nozzles that discharge ink droplets in the different colors. The carriage 101 has a rear side (paper transporting direction downstream side) slidably supported by the main guide rod 109 (i.e., the rear side of the carriage 101 comes into contact with the main guide rod 109 to slide along the main guide rod 109) and a front side (paper transporting direction upstream side) slidably arranged on the sub guide rod 110. A timing belt 114 is fixed to the carriage 101 in order to move the carriage 101 in the main scanning direction. The timing belt 114 is stretched across a drive pulley 112 that is rotated by a main scanning motor and a driven pulley 113 (i.e., the timing belt 114 is arranged over the drive pulley 112 and the driven pulley 113 with tension force). The carriage 101 is moved forward and backward by the forward and backward rotation of a main scanning motor 111.

To transport the paper 105 set on the paper feed cassette 106 to a position below the recording head 1, the inkjet recording apparatus 100 includes a paper feed roller 115 and a friction pad 116 for separately feeding each sheet of paper 105 from the paper fed cassette 106, a guide member 117 for guiding the paper 105, a transport roller 118 for reversing and transporting the paper 105, a transport collar 119 that is pressed to the peripheral face of the transport roller 118, and a tip collar 120 that regulates a transporting angle of the paper 105 from the transport roller 118.

The transport roller 118 is rotated by a sub motor via a gear train (not shown). The paper 105 that is transported by the transport roller 118 to a position below the recording head 1 is guided by a print receiving member 122 corresponding to a paper guide member that guides the paper 105 at the bottom side of the recording head 1. Also, the inkjet recording apparatus 100 has a transport collar 123 and a spur 124 that are driven to transport the paper 105 guided by the print receiving member 122 along a paper delivery direction, a delivery roller 125 and a spur 126 for delivering the paper 105 to a delivery tray 108, and guide members 127 and 128 that form a paper delivery path arranged at the paper transporting direction downstream side of the print receiving member 122.

The inkjet recording apparatus 100 performs image recording operations by driving the recording head 1 according to an image signal while moving the carriage 101 and discharging ink on the paper 105 that is at a standstill to record one line image, and then transporting the paper 105 by a predetermined distance to record the next line image on the paper 105. Upon receiving a recording end signal or a signal indicating that the end of the recording region of the paper 105 has been reached, the recording operations are ended and the paper 105 is delivered to the delivery tray 108. Also, a recovery apparatus 129 for restoring discharge defects of the recording head 1 is arranged at the right side edge of the moving direction of the carriage 101 outside the recording region. The recovery apparatus 129 includes capping means, suction means, and cleaning means. During print standby mode, the carriage 101 may be moved to the recovery apparatus 129 so that the recording head 1 may be capped by the capping means to maintain the moist state of the recording head 1 and prevent discharge defects due to the drying of ink. Also, during recording operations, ink discharge unrelated to image recording may be performed so that the ink viscosity of the ink discharge outlets (nozzles) may be maintained the same and stable discharge performance of the recording head 1 may be ensured.

In a case where a discharge defect occurs, the ink discharge outlets (nozzles) are capped and sealed by the capping means of the recovery apparatus 129, ink and air bubbles are suctioned from the nozzles by the suction means via a tube, and ink and dust particles adhered to the nozzle face are removed by the cleaning means to restore the discharge performance of the recording head 1. The ink suctioned by the suction means is discharged into a waste ink tank (not shown) arranged at the bottom of the recording apparatus main body 100A and is absorbed by an ink absorbing body arranged within the waste ink tank.

According to an aspect of the present embodiment, the inkjet recording apparatus 100 includes the recording head 1, which may be moderately priced by requiring a smaller number of parts and a smaller number of assembly steps to form a common liquid chamber as described below in connection with the second embodiment of the present invention.

COMPARISON EXAMPLE

Figure 3:
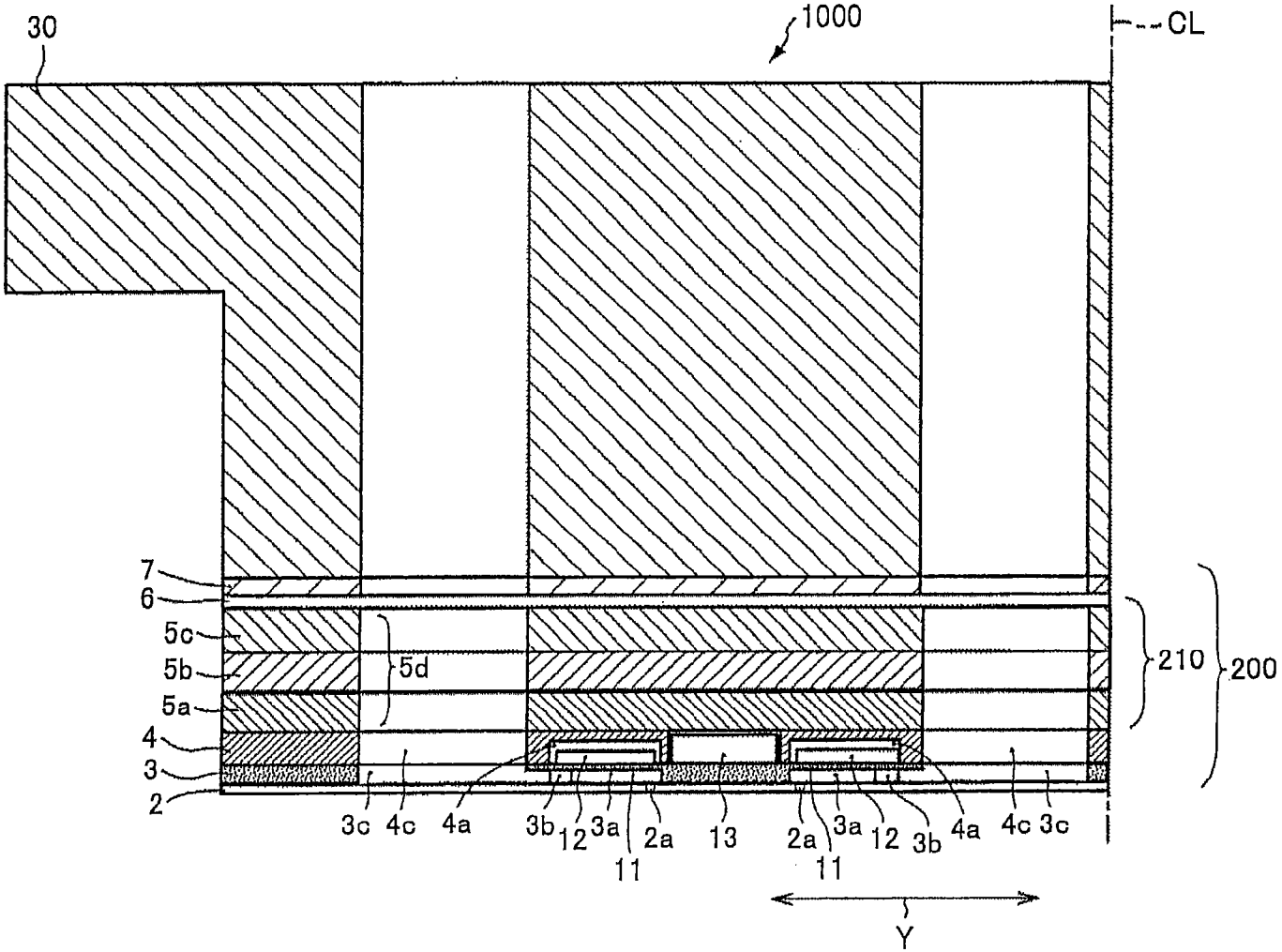
FIG. 3 is a cross-sectional view of a left half portion of an inkjet recording head according to a comparison example.

In the following, an inkjet recording head (also referred to as "recording head" hereinafter) 1000 according to a comparison example is described with reference to FIG. 3. FIG. 3 is a cross-sectional view of a left half portion of the inkjet recording head 1000 from a center line CL.

The recording head 1000 shown in FIG. 3 includes a head body 200 having a structure for discharging ink droplets according to image information, and a housing 30 that supports the head body 200. The head body 200 includes a nozzle substrate 2; a liquid chamber substrate 3; an oscillation plate 11; a piezoelectric element 12; a drive circuit member 13; a liquid supply substrate 4; a common liquid chamber forming substrate 210 corresponding to a multi-layer substrate including common liquid chamber substrates 5*a*, 5*b*, and 5*c*; a damper 6; and a damper frame 7 that are arranged in this order from the bottom side to the top side.

The nozzle substrate 2 has plural nozzle holes 2*a* for discharging ink droplets. The liquid chamber substrate 3 is arranged on the nozzle substrate 2 and has plural pressurizing liquid chambers 3*a* formed thereon. The pressurizing liquid chambers 3*a* are connected to the corresponding nozzle holes 2*a* and their upper walls are formed by the oscillation plate 11. A fluid resistor 3*b* is arranged at one side of the pressurizing liquid chamber 3*a*, and the fluid resistor 3*b* is connected to a fluid supply port 3*c* corresponding to an exemplary fluid introduction path.

The oscillation plate 11 forms a part of the pressurizing liquid chamber 3*a*. The drive circuit member 13 is arranged at the center of the oscillation plate 11, and the piezoelectric elements 12 are arranged at the sides of the drive circuit member 13. The piezoelectric element 12 is arranged on the oscillation plate 11 where the pressurizing liquid chamber 3*a* is located. The piezoelectric element 12 functions as an electromechanical conversion element that is deformed by a voltage applied thereto from the exterior to cause the oscillation plate 11 to deform and the pressurizing liquid chamber 3*a* to generate pressure so that the ink within the pressurizing liquid chamber 3*a* is discharged from the nozzle hole 2*a*.

The piezoelectric element 12 has upper and lower electrodes (not shown) arranged at its upper and lower sides, and the drive circuit member 13 is flip-chip bonded to the corresponding electrode patterns (not shown).

The liquid supply substrate 4 corresponding to an exemplary actuator substrate is arranged on the the liquid chamber substrate 3. The liquid supply substrate 4 has a concave portion 4*a* formed where the oscillation plate 11 is located. The concave portion 4*a* is arranged to enclose the piezoelectric element 12. The common liquid chamber substrates 5*a*, 5*b*, and 5*c* are layered in this order from the bottom side to the top side to form the common liquid chamber forming substrate 210. The common liquid chamber forming substrate 210 including the common liquid chamber substrates 5*a*, 5*b*, and 5*c* is arranged on the the liquid supply substrate 4.

The common liquid chamber substrates 5*a*, 5*b*, and 5*c* each correspond to thin metal plates made of stainless steel (SUS) having a plate thickness of 0.5 mm, for example. The total thickness of the common liquid chamber substrates 5*a*, 5*b*, and 5*c* may be 1.5 mm, for example. The interfaces (bonding faces) of the common liquid chamber substrates 5*a*, 5*b*, and 5*c* are bonded to each other by adhesive to form the common liquid chamber forming substrate 210. The common liquid chamber forming substrate 210 forms a common liquid chamber 5*d* that is in communication with the pressurizing liquid chambers 3*a* via the liquid supply port 3*c* and is configured to supply ink to the pressurizing liquid chambers 3*a*. The common liquid chamber 5*d* is in communication with an ink supply port 4*c* of the liquid supply substrate 4.

By applying a voltage from the exterior to the upper and lower electrodes (not shown) of the piezoelectric element 12 via the drive circuit member 13, stress is applied to the oscillation plate 11 to cause its deformation. This in turn causes the volume of the pressurizing liquid chambers 3*a* to change. Further, by arranging the nozzle substrate 2 with the nozzle holes 2*a* beneath the pressurizing liquid chambers 3*a*, filling the pressurizing liquid chambers 3*a* with ink, and applying a voltage to the upper and lower electrodes of the piezoelectric element 12, pressure is generated by the displacement of the oscillation plate 11 and ink is discharged from the nozzle holes 2*a*.

Second Embodiment

Figure 4:
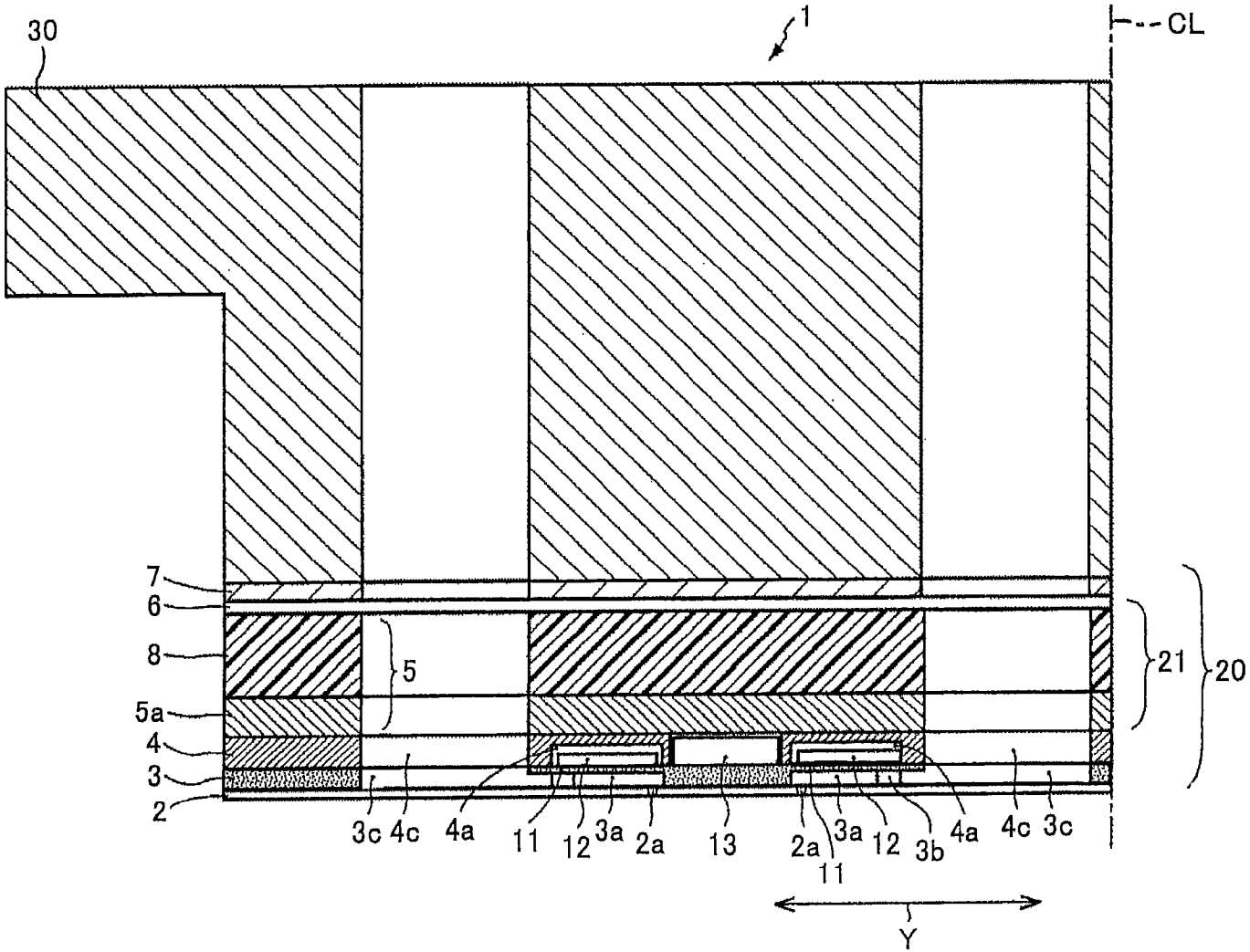
FIG. 4 is a cross-sectional view of a left half portion of an inkjet recording head according to a second embodiment of the present invention.

In the following, the inkjet recording head 1 as an exemplary embodiment of the liquid discharge head according to the present invention is described with reference to FIG. 4. FIG. 4 is a cross-sectional view of a left half portion of the inkjet recording head 1 from center line CL.

The recording head 1 shown in FIG. 4 differs from the recording head 1000 of the above comparison example in that it includes a head body 20 rather than the head body 200. The head body 20 of the recording head 1 includes a common liquid chamber forming substrate 21 rather than the common liquid chamber forming substrate 210 shown in FIG. 3.

The common liquid chamber forming substrate 21 of FIG. 4 includes one common liquid chamber substrate 5*a* and a resin substrate 8 as opposed to the common liquid chamber substrates 5*a*, 5*b*, and 5*c* of the common liquid chamber forming substrate 210 of FIG. 3. It is noted that the other features of the recording head 1 of the second embodiment may be identical to those of the recording head 1000 shown in FIG. 3.

That is, the recording head 1 according to the second embodiment includes the head body 20 having a structure for discharging ink droplets according to image information and a housing 30 that supports the head body 20. The head body 20 includes the nozzle substrate 2; the liquid chamber substrate 3; the oscillation plate 11; the piezoelectric element 12; the drive circuit member 13; the liquid supply substrate 4; the common liquid chamber forming substrate 21 including the common liquid chamber substrate 5*a* and the resin substrate 8; the damper 6; and the damper frame 7 that are arranged in this order from the bottom side to the top side. In the following, features of the recording head 1 according to the second embodiment that differ from those of the recording head 1000 according to the comparison example are described.

The recording head 1 of the second embodiment differs from the recording head 1000 shown in FIG. 3 in that the common liquid chamber forming substrate 21 that forms a common liquid chamber 5 includes the common liquid chamber substrate 5*a* made of stainless steel as an example of a single metal plate that is integrated with the resin plate 8 made of polyphenylene sulfide resin (PPS) as an example of a hard crystalline resin or resin composition. That is, the common liquid chamber forming substrate 21 of the recording head 1 has a hybrid structure that integrates one metal plate with resin to realize a so-called common liquid chamber composite substrate.

The common liquid chamber substrate 5*a* and the resin substrate 8 are integrated through insert molding, which is an injection molding technique, to form the common liquid chamber forming substrate 21. The common liquid chamber 5 is formed within the common liquid chamber forming substrate 21. The common liquid chamber 5 is in communication with the ink supply port 4*c* of the liquid supply substrate 4. The common liquid chamber forming substrate 21 may be formed by the common liquid chamber substrate 5*a* made of a stainless steel thin plate with a thickness of 0.5 mm, for example, and the resin substrate 8 made of polyphenylene sulfide resin (PPS) with a thickness of 1.0 mm, for example, to have a total thickness of 2.0 mm, for example.

In one preferred embodiment, the polyphenylene sulfide resin (PPS) used to form the resin substrate 8 may have fiberglass added thereto at a mass percentage of at least 50%, and more preferably within a range of 50-60%, to achieve a linear coefficient of expansion that is substantially the same as that of stainless steel to thereby prevent deformation of the common liquid chamber forming substrate 21 through temperature change and to secure adequate strength for the partition walls forming the common liquid chamber 5.

Figure 5:
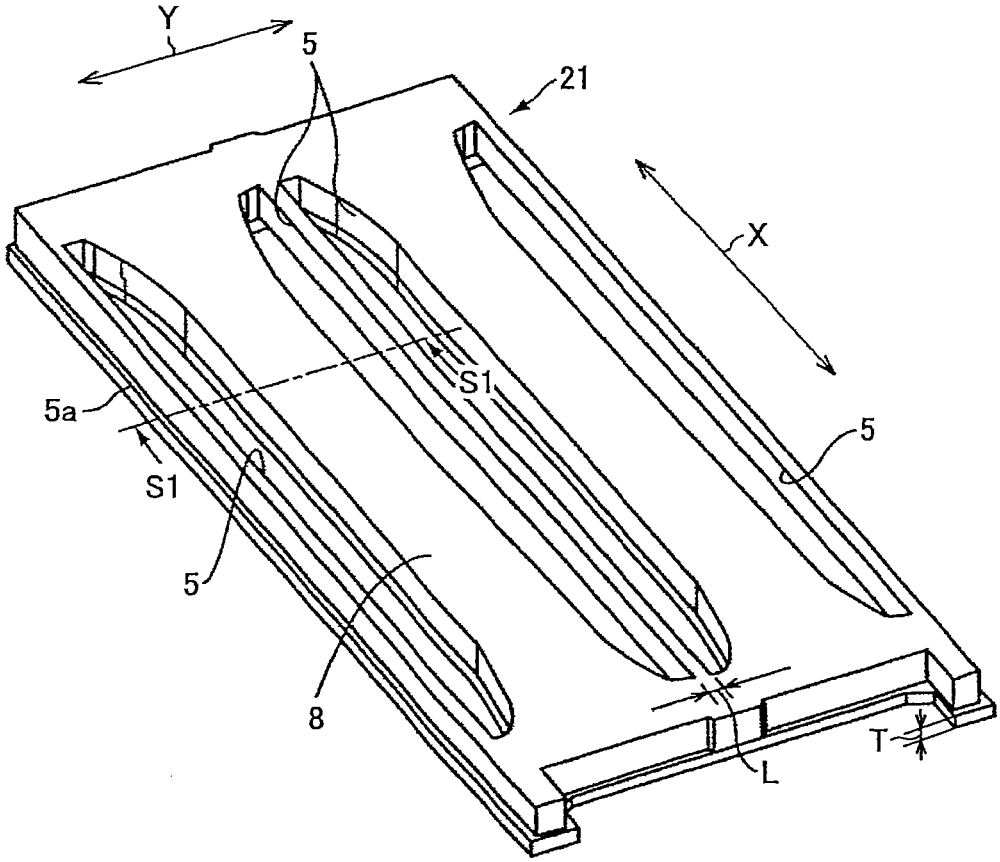
FIG. 5 is a perspective view of a common liquid chamber forming substrate including a common liquid chamber substrate integrated with a resin substrate.

FIG. 5 is a perspective view of the common liquid chamber forming substrate 21 including the common liquid chamber substrate 5*a* integrated with the resin substrate 8. It is noted that in FIG. 5, X represents the longitudinal directions of the common liquid chamber 5 corresponding to a sub scanning direction (paper transporting direction), and Y represents the lateral directions of the common liquid chamber 5 corresponding to the main scanning direction.

The common liquid chamber substrate 5*a* made of stainless steel and the resin substrate 8 made of PPS are integrated through insert molding. The integration is realized by performing a predetermined surface treatment process on at least one side of the stainless steel plate that comes into contact with the PPS (i.e., the surface treatment process may be performed on one side or both sides of the stainless steel plate).

As one example, in the present embodiment, the surface treatment process disclosed in International Patent Publication WO 2009/011398 titled "COMPOSITE OF METAL WITH RESIN AND PROCESS FOR PRODUCING THE SAME" is used. That is, the surface of the steel plate is treated by chemical etching so that the surface is almost entirely covered by ultrafine irregularities of continuous steps having height and depth dimensions of 50-500 nm and a width dimension of several hundreds to several thousands of nm, and the surface forms a thin iron autoxidation film layer on which at least one of hydrazine, ammonia, or a water-soluble amine is chemically adsorbed.

It is noted that the predetermined surface treatment process is not limited to the above process, and other known processes may be used to integrate a surface-treated metal substrate corresponding to a common liquid chamber substrate with a resin substrate through insert molding.

As is described above, the surface of the stainless steel plate corresponding to the common liquid chamber substrate 5*a* is treated beforehand in order to realize an adequately strong bond with melted resin and the surface-treated stainless steel plate is inserted into an injection mold. By injecting melted resin into the injection mold accommodating the common liquid chamber substrate 5*a*, the resin may be securely bonded to the common liquid chamber substrate 5*a* so that the common liquid chamber substrate 5*a* is integrated with the resin substrate 8 to form the common liquid chamber forming substrate 21 upon being removed from the injection mold. According to an aspect of the present embodiment, the common liquid chamber 5 may be formed without undergoing bonding processes so that manufacturing costs may be reduced compared to the comparison example shown in FIG. 3.

Figure 6:
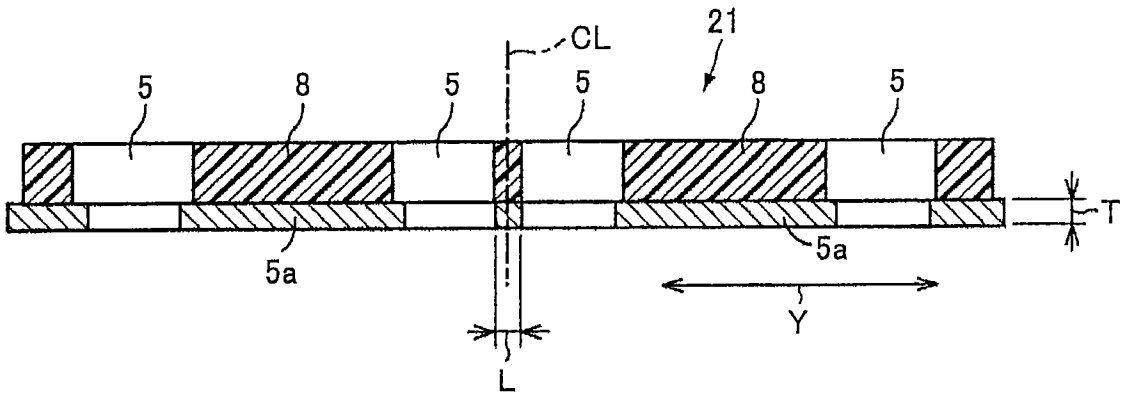
FIG. 6 is a cross-sectional view of the common liquid chamber forming substrate across section S1-S1 of FIG. 5.

FIG. 6 is a cross-sectional view of the common liquid chamber forming substrate 21 across section S1-S1 of FIG. 5. The common liquid chamber substrate 5*a* is fabricated by punch pressing a stainless steel plate. In FIG. 6, L represents the minimum distance between adjacent punch pressed parts, and T represents the thickness of the stainless steel plate. In consideration of the aspect ratio, a relationship of is preferably realized in order to ensure accuracy of the punch pressed product. Thus, in the comparison example, described above, plural layers of common liquid chamber substrates 5*a*-5*c* made of SUS are used to form the common liquid chamber 5*d*.

In the present embodiment, the minimum distance between adjacent punch pressed parts L=0.5 mm, and the plate thickness T=0.5 mm. The minimum distance between adjacent pressed parts L is arranged to be relatively small in the present embodiment in consideration of the cost advantages of reducing the number of layers used to form the liquid supply substrate 4 corresponding to the actuator substrate that is fabricated by chip-processing a silicon wafer.

It has been confirmed through testing that the common liquid chamber forming substrate 21 of the second embodiment that is fabricated by integrating the common liquid chamber substrate 5*a* with the resin substrate 8 using the insert molding technique described above can achieve substantially the same ink resistance, rigidity/strength, ink discharge performance, and other functions and properties as those of the common liquid chamber forming substrate 210 of the comparison example that is fabricated by layering and bonding the common liquid chamber substrates 5*a*-5*c* as shown in FIG. 3.

According to a first aspect of the present embodiment, the common liquid chamber substrate 21 forming the common liquid chamber 5 is fabricated by integrating the common liquid chamber substrate 5*a* corresponding to one single metal plate with the resin substrate 8 made of resin. In this way, the common liquid chamber 5 may be formed without having to stack plural metal plates as in the comparison example shown in FIG. 3 so that the number of parts used to form the common liquid chamber 5 may be reduced, the assembly may be simplified so that the number of assembly steps may be reduced, and the recording head 1 may be reduced in price.

According to a second aspect of the present embodiment, the common liquid chamber substrate 5*a* and the resin substrate 8 are integrally formed using the injection molding technique (insert molding) so that the common liquid chamber forming substrate 21 may be fabricated at a relatively low cost.

According to a third aspect of the present embodiment, a predetermined surface treatment process is performed on at least one side of the common liquid chamber substrate 5*a* that comes into contact with resin so that partition walls of the common liquid chamber substrate 5*a* may be accurately formed with adequate strength despite its reduced thickness.

According to a fourth aspect of the present embodiment, one face of the common liquid chamber substrate 5*a* is bonded to the liquid supply substrate 4 corresponding to the actuator substrate while the other face of the common liquid chamber 5*a* is integrally bonded to the resin substrate 8. By arranging the bonding face with the actuator substrate that is fabricated by chip-processing a silicon wafer to be a metal plate surface with desirable planar accuracy, bonding accuracy may be maintained, and the amount (thickness) of adhesive applied to the bonding face with the actuator substrate may be reduced.

According to a fifth aspect of the present embodiment, the common liquid chamber substrate 5*a* corresponding to the metal plate may be a thin stainless steel plate so that the predetermined treatment process described above for integrating the metal plate with resin may be performed on the common liquid chamber substrate 5*a*.

According to a sixth aspect of the present embodiment, the resin substrate 8 may be made of polyphenylene sulfide resin (PPS) so that adequate ink resistance may be secured.

According to a seventh aspect of the present embodiment, fiberglass may be included in the polyphenylene sulfide resin (PPS) at a mass percentage of at least 50%. In this way, the coefficient of linear expansion of the resin may be substantially the same as that of the common liquid chamber substrate 5*a* made of the stainless steel plate so that deformation of the common liquid chamber forming substrate 21 due to temperature change may be prevented and partition walls forming the common liquid chamber 5 may have adequate strength.

Figure 7A:
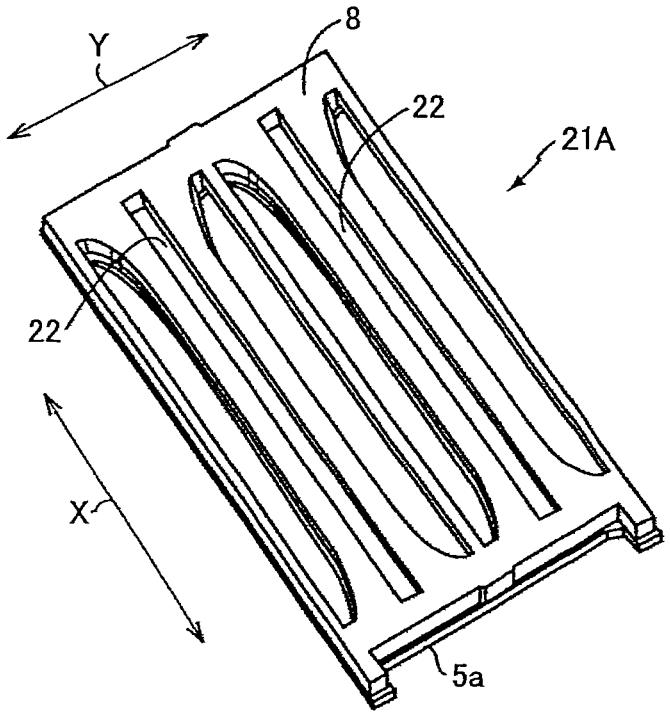
FIGS. 7A and 7B are perspective views of the common liquid chamber forming substrate according to modified embodiments.
Figure 7B:
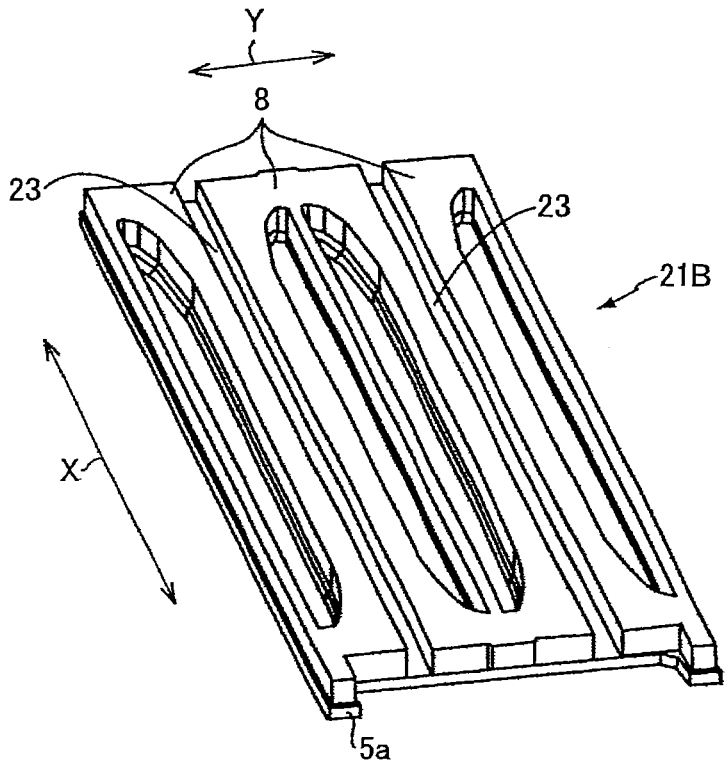

In the following, exemplary modifications of the second embodiment are described with reference to FIGS. 7A-7B. FIG. 7A is a perspective view of a common liquid chamber forming substrate 21A according to a first modified embodiment. FIG. 7B is a perspective view of a common liquid chamber forming substrate 21B according to a second modified embodiment.

The common liquid chamber forming substrate 21A shown in FIG. 7A differs from the common liquid chamber forming substrate 21 shown in FIG. 5 in that it has plural slits 22 extending along the longitudinal directions X corresponding to a resin flow direction arranged on the resin substrate 8.

It is noted that after the resin substrate 8 is integrally bonded to the common liquid chamber substrate 5*a* within the injection mold, the resin substrate 8 may contract to cause warping of the common liquid chamber substrate 5*a* that is made of stainless steel. By arranging the slits 22 on the resin substrate 8 along the longitudinal directions X corresponding to the resin flow direction as is shown in FIG. 7A, the contraction force of the resin substrate 8 may be disrupted so that warping of the common liquid chamber substrate 5*a* made of stainless steel may be reduced or prevented.

In the common liquid chamber forming substrate 21B according to the second modified embodiment as shown in FIG. 7B, plural slits 23 are arranged to extend along the resin flow direction on the resin substrate 8 such that the resin substrate 8 is divided into three sections. In this way, warping of the common liquid chamber substrate 5*a* made of stainless steel may be reduced or prevented even more effectively.

According to an aspect of the first and second modified embodiments, by arranging plural slits on the resin substrate 8 along the resin flow direction, the contraction force of the resin substrate 8 may be disrupted to thereby prevent warping of the common liquid chamber substrate 5*a* made of stainless steel.

Third Embodiment

Figure 8:
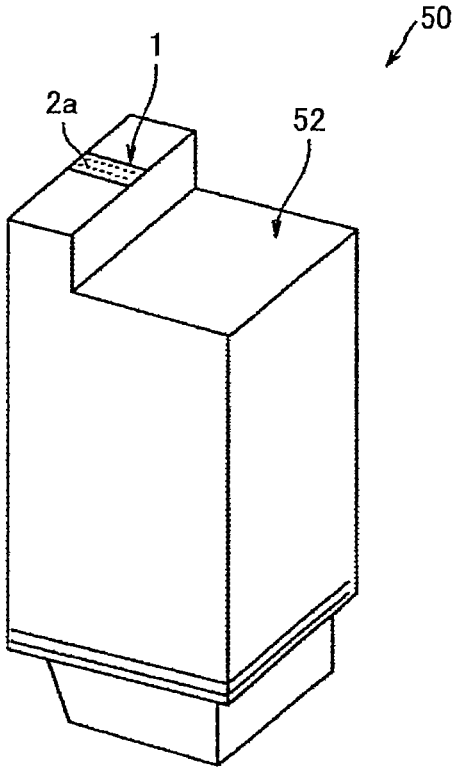
FIG. 8 is a perspective view of an ink cartridge according to a third embodiment of the present invention.

In the following, a third embodiment of the present invention is described with reference to FIG. 8. The third embodiment relates to an ink cartridge 50 corresponding to an exemplary embodiment of a liquid droplet discharge apparatus of the present invention. The ink cartridge 50 has the recording head 1 with the nozzle holes 2*a* according to the second embodiment integrated with an ink tank 52 that stores ink to be supplied to the common liquid chamber 5 (see FIG. 4) of the recording head 1.

According to an aspect of the present embodiment, by integrating the ink tank 52 with the recording head 1, the overall cost of the ink cartridge 50 may be reduced owing to the reduced cost of the recording head 1. In this way, cost reduction of the recording head-integrated ink cartridge 50 may be realized.

Further, the present invention is not limited to these embodiments, and numerous variations and modifications may be made without departing from the scope of the present invention.

For example, the present invention is not limited to an inkjet recording head that discharges droplets of ink but also encompasses other types of liquid droplet discharge heads that discharge some other type of liquid. Also, the present invention is not limited to application in an image forming apparatus but may also be applied in other types of apparatuses such as a patterning apparatus that uses a liquid droplet discharge head.

The image forming apparatus according to the present invention is not limited to the inkjet recording apparatus 100 shown in FIGS. 1 and 2 but encompasses other types of image forming apparatuses including other types of inkjet recording apparatuses that use the recording head 1 according to an embodiment of the present invention. For example, the present invention may be applied to a printing apparatus such as a printer, a plotter, a word processor, a facsimile machine, a copier, a screen printing machine, or a multifunction peripheral including more than one of the above functions.

The present application is based on and claims the benefit of the priority of Japanese Patent Application No. 2012-

002533 filed on Jan. 10, 2012, with the Japanese Patent Office, the entire contents of which are hereby incorporated by reference.

What is claimed is:

1. A liquid droplet discharge head comprising:

a nozzle substrate that has a nozzle hole for discharging a liquid droplet;

a liquid chamber substrate that includes a liquid chamber that is in communication with the nozzle hole and a liquid introduction path for introducing liquid into the liquid chamber;

an oscillation plate that forms a part of the liquid chamber;

an electromechanical conversion element that is arranged on the oscillation plate at a location corresponding to the liquid chamber, the electromechanical conversion element being deformed by a voltage applied from an exterior to cause the oscillation plate to deform and the liquid chamber to generate pressure so that the liquid within the liquid chamber is discharged from the nozzle hole;

a common liquid chamber that is in communication with the liquid chamber via the liquid introduction path and is configured to supply the liquid to the liquid chamber; and a common liquid chamber forming substrate that includes a single metal plate integrated with a resin substrate to form the common liquid chamber, wherein a through hole is formed in the resin substrate and a through hole is formed in the metal plate, and the through hole formed in the resin substrate and the through hole formed in the metal plate integrally form the common liquid chamber, wherein a liquid supply substrate is arranged between the common liquid chamber substrate and the liquid chamber substrate, the liquid supply substrate includes an ink supply port that is in communication with the common liquid chamber, and a concave portion corresponding to an opening formed where the oscillation plate is located, the liquid supply substrate is arranged on the oscillation plate, and in such state, a piezoelectric element is accommodated between the concave portion and the oscillation plate, and the face of the metal plate on the opposite side of the resin substrate is bonded to the face of the liquid supply substrate opposite the face at which the concave portion is formed.

2. The liquid droplet discharge head as claimed in claim 1, wherein the metal plate and the resin substrate are integrated through injection molding.

3. The liquid droplet discharge head as claimed in claim 1, wherein a predetermined surface treatment process is performed on at least one face of the metal plate that comes into contact with the resin substrate.

4. The liquid droplet discharge head as claimed in claim 1, wherein a first face of the metal plate is bonded to an actuator substrate and a second face of the metal plate is integrally bonded to the resin substrate.

5. The liquid droplet discharge head as claimed in claim 1, wherein the metal plate includes a stainless steel thin plate.

6. The liquid droplet discharge head as claimed in claim 1, wherein the common liquid chamber forming substrate includes a plurality of slits that are arranged to extend along a flow direction of the resin substrate.

7. The liquid droplet discharge head as claimed in claim 1, wherein the resin substrate comprises a polyphenylene sulfide resin.

8. The liquid droplet discharge head as claimed in claim 7, wherein the polyphenylene sulfide resin comprises at least 50 mass % of fiberglass.

9. A liquid droplet discharge apparatus comprising:

a liquid droplet discharge head comprising a nozzle substrate that has a nozzle hole for discharging a liquid droplet;

a liquid chamber substrate that includes a liquid chamber that is in communication with the nozzle hole and a liquid introduction path for introducing liquid into the liquid chamber;

an oscillation plate that forms a part of the liquid chamber;

an electromechanical conversion element that is arranged on the oscillation plate at a location corresponding to the liquid chamber, the electromechanical conversion element being deformed by a voltage applied from an exterior to cause the oscillation plate to deform and the liquid chamber to generate pressure so that the liquid within the liquid chamber is discharged from the nozzle hole;

a common liquid chamber that is in communication with the liquid chamber via the liquid introduction path and is configured to supply the liquid to the liquid chamber;

a common liquid chamber forming substrate that includes a single metal plate integrated with a resin substrate to form the common liquid chamber; and a tank that stores the liquid to be supplied to the common liquid chamber of the liquid droplet discharge head, wherein a liquid supply substrate is arranged between the common liquid chamber substrate and the liquid chamber substrate, the liquid supply substrate includes an ink supply port that is in communication with the common liquid chamber, and a concave portion corresponding to an opening formed where the oscillation plate is located, the liquid supply substrate is arranged on the oscillation plate, and in such state, a piezoelectric element is accommodated between the concave portion and the oscillation plate, and the face of the metal plate on the opposite side of the resin substrate is bonded to the face of the liquid supply substrate opposite the face at which the concave portion is formed.

10. An image forming apparatus comprising:

a liquid droplet discharge head comprising a nozzle substrate that has a nozzle hole for discharging a liquid droplet;

a liquid chamber substrate that includes a liquid chamber that is in communication with the nozzle hole and a liquid introduction path for introducing liquid into the liquid chamber;

an oscillation plate that forms a part of the liquid chamber;

an electromechanical conversion element that is arranged on the oscillation plate at a location corresponding to the liquid chamber, the electromechanical conversion element being deformed by a voltage applied from an exterior to cause the oscillation plate to deform and the liquid chamber to generate pressure so that the liquid within the liquid chamber is discharged from the nozzle hole;

a common liquid chamber that is in communication with the liquid chamber via the liquid introduction path and is configured to supply the liquid to the liquid chamber; and a common liquid chamber forming substrate that includes a single metal plate integrated with a resin substrate to form the common liquid chamber, wherein a liquid supply substrate is arranged between the common liquid chamber substrate and the liquid chamber substrate, the liquid supply substrate includes an ink supply port that is in communication with the common liquid chamber, and a concave portion corresponding to an opening formed where the oscillation plate is located, the liquid supply substrate is arranged on the oscillation plate, and in such state, a piezoelectric element is accommodated between the concave portion and the oscillation plate, and the face of the metal plate on the opposite side of the resin substrate is bonded to the face of the liquid supply substrate opposite the face at which the concave portion is formed.

11. The liquid droplet discharge head as claimed in claim 1, wherein the through hole formed in the resin substrate has a greater depth than the through hole formed in the metal plate.

12. The liquid droplet discharge head as claimed in claim 1, wherein the liquid chamber is pressurizing and is connected to the nozzle hole and the upper wall of the liquid chamber is formed by the oscillation plate.

13. The liquid droplet discharge head as claimed in claim 1, wherein a fluid resistor is arranged at one side of the pressurizing liquid chamber, and the fluid resistor is connected to a liquid supply port corresponding to the fluid introduction path.

14. The liquid droplet discharge head as claimed in claim 1, wherein the oscillation plate forms a part of the pressurizing liquid chamber.

15. The liquid droplet discharge head as claimed in claim 1, wherein a drive circuit member is arranged at the center of the oscillation plate, and the piezoelectric element is arranged at the side of the drive circuit member, wherein the piezoelectric element is arranged on the oscillation plate where the pressurizing liquid chamber is located.

16. The liquid droplet discharge head as claimed in claim 1, comprising a plurality of common liquid chambers.

17. The liquid droplet discharge head as claimed in claim 16, wherein each common liquid chamber is in communication with a corresponding liquid supply port of a liquid supply substrate.

18. The liquid droplet discharge head as claimed in claim 15, comprising a plurality of piezoelectric element, a plurality of oscillation plate, and a plurality of pressurizing liquid chambers, wherein the piezoelectric elements are arranged at the sides of the drive circuit member, wherein the piezoelectric elements are arranged on corresponding oscillation plates where corresponding pressurizing liquid chambers are located.

19. The liquid droplet discharge apparatus of claim 9, wherein a through hole is formed in the resin substrate and a through hole is formed in the metal plate, and the through hole formed in the resin substrate and the through hole formed in the metal plate integrally form the common liquid chamber.

20. The image forming apparatus of claim 10, wherein a through hole is formed in the resin substrate and a through hole is formed in the metal plate, and the through hole formed in the resin substrate and the through hole formed in the metal plate integrally form the common liquid chamber.

* * * * *